US011209242B2

(12) United States Patent
Kowalczyk, Jr. et al.

(10) Patent No.: US 11,209,242 B2
(45) Date of Patent: Dec. 28, 2021

(54) RECOIL SPRING GUIDE MOUNTED TARGET MARKER

(71) Applicant: Crosman Corporation, Bloomfield, NY (US)

(72) Inventors: John A. Kowalczyk, Jr., Fairport, NY (US); Jeffrey W. Mock, Rochester, NY (US); Jeffrey D. Tuller, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/259,550

(22) Filed: Jan. 28, 2019

(65) Prior Publication Data

US 2019/0271525 A1 Sep. 5, 2019

Related U.S. Application Data

(63) Continuation of application No. 15/243,380, filed on Aug. 22, 2016, now Pat. No. 10,190,847, which is a continuation of application No. 14/079,149, filed on Nov. 13, 2013, now Pat. No. 9,423,213.

(60) Provisional application No. 61/726,222, filed on Nov. 14, 2012.

(51) Int. Cl.

| | |
|---|---|
| ***F41G 1/35*** | (2006.01) |
| ***F41G 1/36*** | (2006.01) |
| ***F41A 5/02*** | (2006.01) |
| ***F41G 3/14*** | (2006.01) |
| ***F41C 3/00*** | (2006.01) |

(52) U.S. Cl.

CPC ..... *F41G 1/35* (2013.01); *F41A 5/02* (2013.01); *F41C 3/00* (2013.01); *F41G 1/36* (2013.01); *F41G 3/145* (2013.01)

(58) Field of Classification Search

CPC . F41G 11/001; F41G 1/36; F41G 1/34; F41G 1/35

USPC ..... 42/114, 115, 117

See application file for complete search history.

(56) References Cited

U.S. PATENT DOCUMENTS 3,513,581 A * 5/1970 Slater ..... F41G 1/35 42/146

4,161,076 A * 7/1979 Snyder ..... F41G 11/002 362/113

(Continued)

OTHER PUBLICATIONS

Goldwasser, "Sam's Laser FAQ", Jun. 30, 2007, retrieved on May 2, 2017 at https://web.archive.org/web/20070630095455/https://www.repairfaq.org/sam/laserssl.htm#ssleslp, 76 pages.

*Primary Examiner* — Joshua E Freeman

(74) *Attorney, Agent, or Firm* — Lee & Hayes, P.C.

(57) ABSTRACT

In an exemplary embodiment of the present disclosure, a target marker for a firearm may comprise a module having a first portion, and a second portion electrically connected and coupled to the first portion. A light source may be disposed within and electrically connected to the second portion. An optical component may be coupled to the first portion at a first fixed distance from the light source. A circuit board may be electrically connected to the light source via at least one lead, wherein the lead may permit relative movement between the circuit board and the light source and may maintain a second fixed distance between the circuit board and the light source.

10 Claims, 3 Drawing Sheets

(56) References Cited

U.S. PATENT DOCUMENTS 4,168,588 A * 9/1979 Snyder ..... F41G 11/002 42/115
4,934,086 A * 6/1990 Houde-Walter ..... F41A 3/86 362/110
5,121,188 A * 6/1992 Patridge ..... G02B 6/4204 257/680
5,299,375 A * 4/1994 Thummel ..... F41G 1/35 362/110
5,323,555 A * 6/1994 Jehn ..... F41G 1/36 42/115
5,351,429 A * 10/1994 Ford ..... F41G 1/35 362/110
5,355,608 A * 10/1994 Teetzel ..... F41A 9/62 362/113
5,375,362 A * 12/1994 McGarry ..... F41A 35/06 42/117
5,388,364 A * 2/1995 Paldino ..... F41G 1/35 362/114
5,392,550 A * 2/1995 Moore ..... F41G 1/35 362/110
5,419,072 A * 5/1995 Moore ..... F41G 1/35 362/114
5,509,226 A * 4/1996 Houde-Walter ..... F41G 1/35 362/110
5,531,040 A * 7/1996 Moore ..... F41G 1/35 362/114
5,685,106 A * 11/1997 Shoham ..... F41A 33/02 42/116
5,694,713 A * 12/1997 Paldino ..... F41G 1/35 33/DIG. 21
5,704,153 A * 1/1998 Kaminski ..... F41A 17/063 42/117
5,771,623 A * 6/1998 Pernstich ..... F41G 1/38 356/3.03
5,784,823 A * 7/1998 Chen ..... F41G 11/001 362/110
5,787,631 A * 8/1998 Kendall ..... F41A 33/02 42/116
5,909,951 A * 6/1999 Johnsen ..... F41A 33/02 362/111
6,216,381 B1 * 4/2001 Strand ..... F41A 33/02 42/113
6,230,431 B1 * 5/2001 Bear ..... F41G 1/35 362/114
6,237,271 B1 * 5/2001 Kaminski ..... F41A 17/063 42/70.01
6,892,488 B1 * 5/2005 Serravalle ..... F41A 5/02 42/113
7,472,830 B2 * 1/2009 Danielson ..... F41G 1/35 235/404
8,485,858 B2 * 7/2013 Wei ..... F41G 1/35 446/473
8,584,587 B2 * 11/2013 Uhr ..... F41G 3/2655 102/444
2002/0129536 A1 * 9/2002 Iafrate ..... F41A 33/02 42/134
2011/0252681 A1 * 10/2011 Houde-Walter ..... F41G 1/35 42/1.01
2013/0185981 A1 * 7/2013 Brabandt ..... F41G 1/35 42/117
2014/0130394 A1 * 5/2014 Kowalczyk, Jr. ..... F41A 5/02 42/114
2015/0155676 A1 * 6/2015 Hansen ..... G02B 27/0927 250/349

* cited by examiner

RECOIL SPRING GUIDE MOUNTED TARGET MARKER

FIELD OF THE INVENTION

The present disclosure is directed to a target marker and, more particularly, to a target marker mounted in a recoil spring guide of a firearm.

BACKGROUND OF THE INVENTION

Firearm users sometimes require increased sighting capacity to ensure accurate bullet impact. However, accurately shooting a handheld firearm may be difficult. For instance, the front and rear sights on a handheld firearm are relatively close together causing a corresponding short sighting field. Such a short sighting field may make it difficult to aim the firearm accurately. In addition, pistols and other handheld firearms may be difficult to hold steady while shooting since, unlike rifles or shotguns, such handheld firearms do not include a buttstock or other component configured to rest against the shoulder of the user. Handheld firearm users may also have difficulty accurately setting up the line of sight between the user's dominant eye and the length of the barrel.

Additionally, environmental conditions and/or other mitigating circumstances may make it difficult for the user to properly sight their firearm prior to shooting. For example, in low-light conditions, the user may not be able to properly see and align the sights on the handheld firearm. Additionally, the user may be involved in a stress-fire situations that may involve rapid shooting or require the user to fire from behind cover. Alternatively, the user themselves may have reduce sighting capacity, for example, the user may have diminished eye sight. In these exemplary situations, the user may benefit from the use a target marker, and specifically, a light source used as a target marker. A light source target marker may aid the user with higher and/or quicker shooting accuracy.

Usually, these target markers are mounted as an additional component on the outside of the firearm. However, such externally-mounted target markers may affect the balance of the firearm and may make it difficult to holster the firearm after use. Externally-mounted target markers may also be easily knocked out of alignment. Additionally, mounting such target markers may require firearm modifications to be performed by a professional gunsmith.

To address these issues, some manufactures produce target markers mounted internally to the firearm, but internally-mounted target markers present their own issues. For example, internally-mounted target markers can be difficult to align and focus resulting in a higher cost to manufacture.

Exemplary embodiments of the present disclosure are directed at solving one or more of the problems set forth above and/or other problems in the art.

SUMMARY OF THE INVENTION

In an exemplary embodiment of the present disclosure, a target marker for a firearm may include a module having a first portion, and a second portion electrically connected and coupled to the first portion. A light source may be disposed within and electrically connected to the second portion. An optical component may be coupled to the first portion at a first fixed distance from the light source. A circuit board may be electrically connected to the light source via at least one lead, wherein the lead may permit relative movement between the circuit board and the light source; and the lead may maintain a second fixed distance between the circuit board and the light source.

In another exemplary embodiment of the present disclosure, a target marker for a firearm may include a module having a first portion, and a second portion electrically connected and coupled to the first portion. A light source may be coupled to and electrically connected to the second portion, and an optical component may be coupled to the first portion at a first fixed distance from the light source. A circuit board may be electrically connected to the light source, and may be disposed at a second fixed distance from the light source. The module may be disposed at least partially within a recoil spring guide defining a longitudinal axis and the light source is movable in a direction substantially transverse to the longitudinal axis while maintaining the second fixed distance from the circuit board.

In a further exemplary embodiment of the present disclosure, a method for calibrating a target marker is disclosed, the method comprising electrically connecting a light source to a module, wherein the light source is disposed substantially within the module. The method may further comprise disposing the module at least partially within a recoil spring guide configured for use with a handheld firearm and electrically connecting a fastener to the module, the fastener being configured to change a position of the module relative to the recoil spring guide via relative movement between the fastener and the recoil spring guide. Further, the method may comprise electrically connecting, via at least one lead, the light source to a circuit board disposed at least partially within the recoil spring guide, wherein the light source is moveable relative to the circuit board; and maintaining, via the at least one lead, a fixed axial distance between the circuit board and the light source.

DESCRIPTION OF THE EMBODIMENTS

Figure 1:
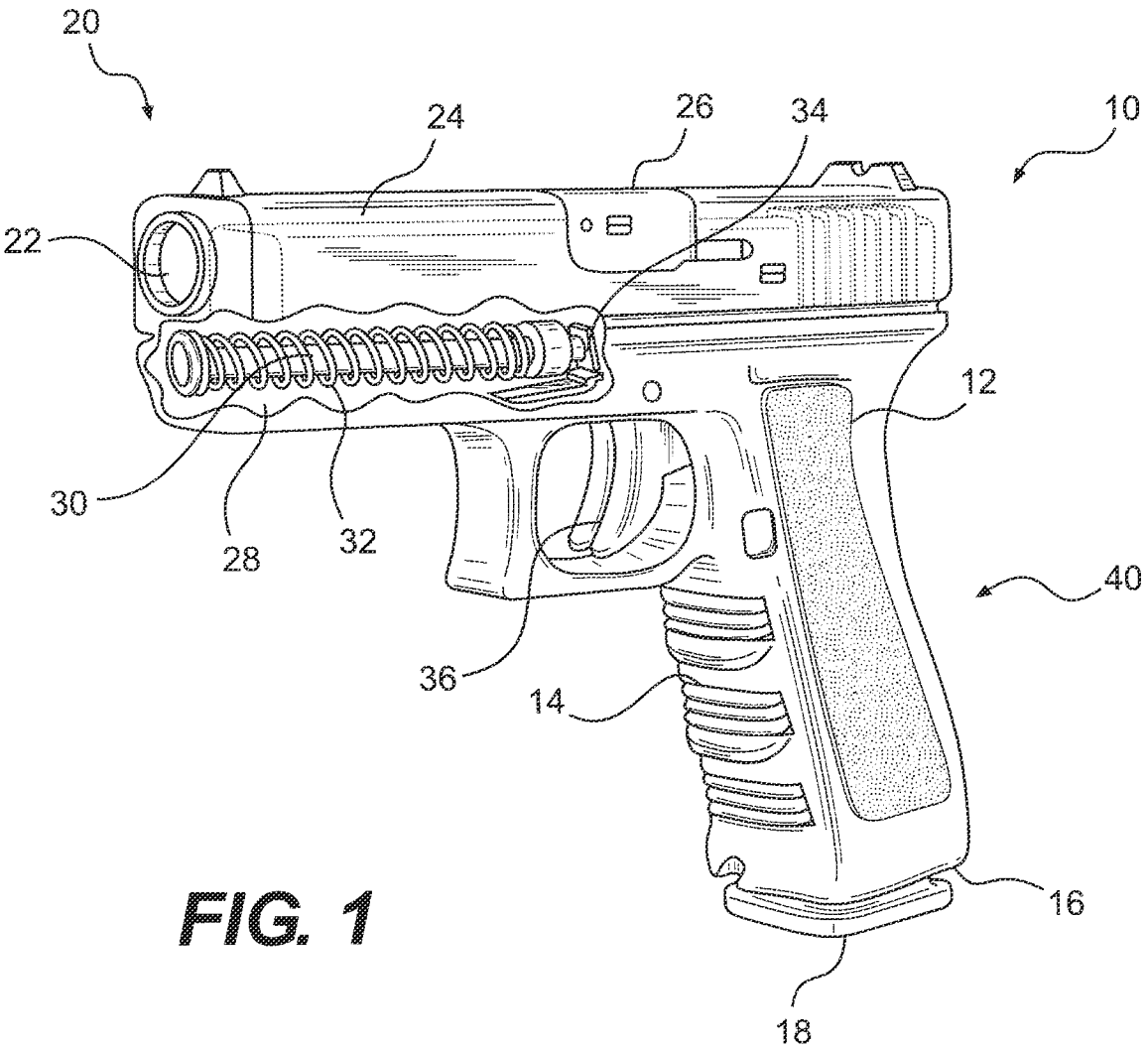
FIG. 1 illustrates an exemplary firearm with a recoil spring guide.

FIG. 1 illustrates an embodiment of an exemplary firearm 10. The firearm 10 may be a handheld firearm such as a pistol, handgun, or other like device. The firearm 10 may have a frame 12, and the frame 12 may include a grip 14. On the bottom of the grip 14, there may be a magazine well 16. The magazine well 16 may have a magazine 18 inserted into it. The magazine 18 may include a number of rounds of ammunition (not shown) and the ammunition may include a shell having a bullet, propellant, and primer disposed therein. The firearm 10 may include a trigger 36 that, when depressed properly, may cause a hammer (not shown) of the firearm 10 to strike the primer, which may ignite the propellant and discharge the bullet from a barrel 22 of the firearm 10. The barrel 22 may be housed within a slide 24. When the bullet is discharged from the firearm 10, the bullet may exit the firearm 10 via the muzzle end 20 of the barrel 22. Shells from spent rounds of ammunition may then be ejected from an ejection port 26 of the firearm 10 when the slide 24 moves from the muzzle end 20 of the firearm 10 towards a rear 40 of the firearm 10.

The firearm 10 may also include a slide lock 34. The slide lock 34 may enable the removal of the slide 24 from the firearm 10. The slide lock 34 may be removable from the firearm 10. As such, the slide lock 34 may be replaced by a non-manufacturer issued slide lock. In some embodiments, the slide lock 34 may act as a switch for a target marker 50 (FIG. 2) associated with the firearm 10. Such target markers 50 will be discussed below. In such embodiments, the slide lock 34 may be configured to complete an electrical circuit 176 (FIG. 5) that may provide power to one or more components of the target marker 50. The slide lock 34 may also disconnect power from such components and form an open circuit. For example, in some embodiments, the slide lock 34 may be configured with an insulated portion. The insulated portion may be located in a central part of the slide lock 34. When engaged, the insulated portion may form an open circuit for one or more components of the target marker 50. The slide lock 34 may further include a conductive portion that, when engaged, may form a closed circuit to provide power to one or more of the components of the target marker 50. In exemplary embodiments, the slide lock 34 may have multiple insulated and/or conductive portions. For example, the slide lock 34 may have two or more conductive portions and an insulated portion disposed between the two or more conductive portions.

The slide lock 34 may be configured to translate, along an axis perpendicular to an axis of the barrel 22 of the firearm 10, between two or more positions. In an exemplary embodiment, a first position of the slide lock 34 may assist in forming the open circuit described above and a second position of the slide lock 34 may assist in forming the closed circuit. In some embodiments, the slide lock 34 may contain a third position that may also assist in forming the closed circuit. In some embodiments, the user of the firearm 10 may change the position of the slide lock 34, therein engaging one of the conductive and non-conductive portions, with either their left hand or their right hand. The slide lock 34 may further be configured such that the user may maintain their hold on the grip 14 while positioning the slide lock 34. The user may use their preferred trigger finger, or another finger, to change the position of the slide lock 34, thereby forming either an open or closed circuit for the target marker 50. It is understood that such a closed circuit may activate the target marker 50 and such an open circuit may deactivate the target marker 50.

The firearm 10 may include a recoil chamber 28 disposed between slide 24 and the frame 12, and a recoil spring guide 30 may be located within the recoil chamber 28. A recoil spring 32 may be mounted onto the recoil spring guide 30 such that the recoil spring guide 30 may be substantially contained within the recoil spring 32. The recoil spring 32 may have a number of functions. For example, the recoil spring 32 may be configured to slow the momentum of the slide 24 as it moves from the muzzle end 20 of the firearm 10 towards the rear 40 of the firearm 10. Such movement of the slide 24 may occur, for example, in reaction to the propellant being ignited and the bullet discharged from the firearm 10. The recoil spring guide 30 may guide expansion and/or contraction of the spring 32 during this process.

In exemplary embodiments, the recoil spring guide 30 may be substantially solid or substantially hollow. The recoil spring guide 30 and recoil spring 32 may be disposed substantially parallel to the barrel 22 of the firearm 10. The recoil spring guide 30 may be replaced with a substitute recoil spring guide 30 without any significant or necessary modifications to the firearm 10, and in such embodiments, a target marker 50 (FIG. 2) may be disposed within the substitute recoil spring guide 30.

Figure 2:
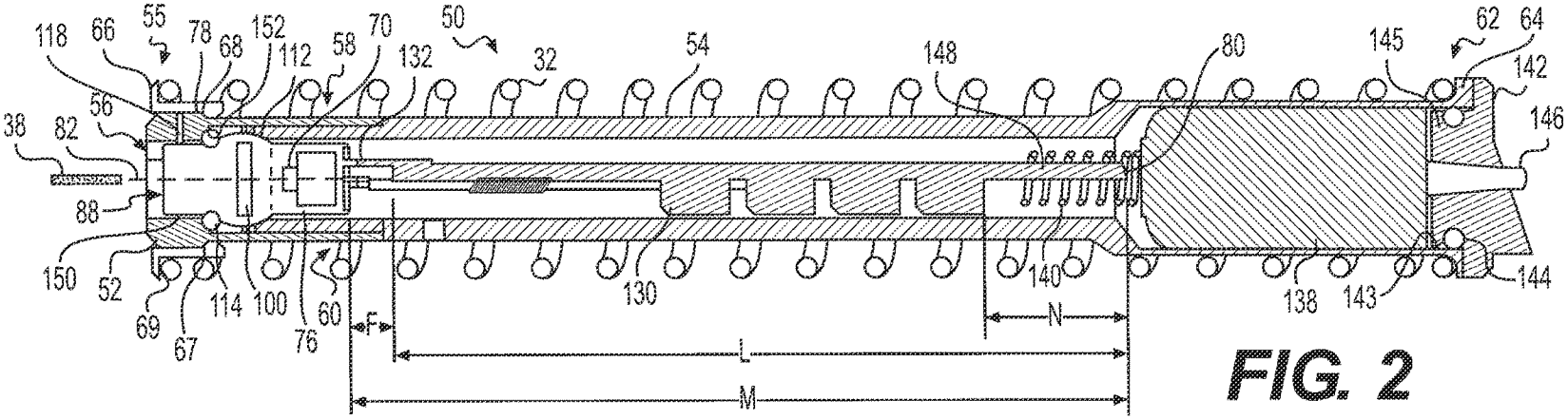
FIG. 2 is a cross-sectional view of the exemplary recoil spring guide shown in FIG. 1.

FIG. 2 is a cross-section of an exemplary recoil spring guide 30 having a target marker 50 substantially disposed therein. The recoil spring guide 30 may be a one-piece component of the firearm 10. Alternatively, the recoil spring guide 30 may comprise two or more pieces coupled together. For example, an exemplary recoil spring guide 30 may include a substantially-cylindrical head 52 and a substantially-cylindrical tube 54 coupled to the head 52 defining a longitudinal axis 82 of the recoil spring guide 30. The head 52 may include a first opening 56 on a first end 55 of the head 52. The head 52 may also include a second end 58 opposite the first end 55, and the second end 58 may be configured to mate with a first end 60 of the tube 54 such that the head 52 and the tube 54 form a hollow connection. The head 52 and tube 54 may be assembled in a variety of ways. For example, the second end 58 of the head 52 and the first end 60 of the tube 54 may each include corresponding threads such that the head 52 and the tube 54 form a threaded connection. The head 52 and the tube 54 may also be press fit together, adhered together, and/or otherwise coupled together in any known way. The tube 54 may have a second end 62 opposite the first end 60 configured to accept a cover 142 (discussed below). The head 52 and the tube 54 may be oriented in the firearm 10 such that the first opening 56 of the head 52 is disposed proximate the muzzle end 20 of the firearm 10 and the second end 62 of the tube 54 is disposed proximate the rear 40 of the firearm 10.

Figure 3:
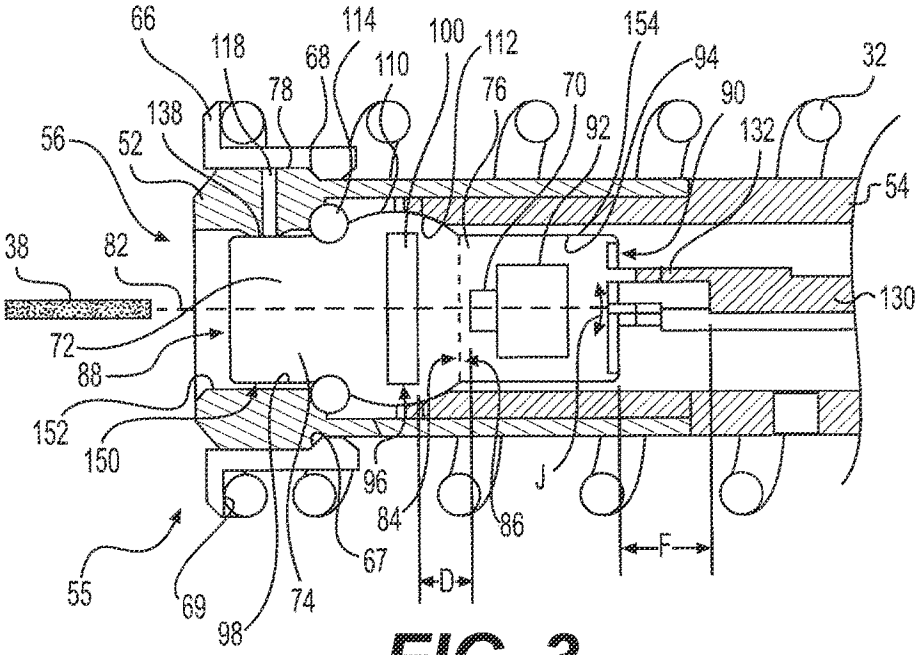
FIG. 3 is a close-up view of the exemplary recoil spring guide shown in FIG. 2.

As shown in greater detail in FIG. 3, a captivator 66 may be substantially disposed around the head 52 of the recoil spring guide 30 and may be configured to prohibit the spring 32 from extending beyond the head 52 during operation of the firearm 10. In an exemplary embodiment, the captivator 66 may comprise a substantially cylindrical collar configured for mechanical and/or electrical connection with the first end 55 of the head 52. For example, the captivator 66 may include a first shoulder 67 configured to mate with a corresponding shoulder 68 of the head 52. In an exemplary embodiment, the captivator 66 may comprise separate first and second semi-cylindrical pieces, and such pieces may mate and/or otherwise connect together around an outer surface 78 and/or circumference of the recoil spring guide 30. In various embodiments described herein, the captivator 66 may also include a second shoulder 69 extending substantially perpendicular from the longitudinal axis 82 of the recoil spring guide 30 and configured to mate with the recoil spring 32. For example, the second shoulder 69 may assist in retaining the recoil spring 32 between the captivator 66 and a flange 64 (FIG. 2) on the second end 62 of the tube 54. The captivator 66 may be in contact with the head 52, and the captivator 66 may be electrically connected to the head 52 via such contact. In an exemplary embodiment, the captivator 66 and the head 52 may each comprise electrically conductive materials, and the mechanical contact between the captivator 66 and the head 52 may also provide an electrical connection there between.

With continued reference to FIG. 3, in exemplary embodiments, a module 72 containing a light source 70 may be disposed within the head 52 of the recoil spring guide 30. In some embodiments, the module 72 may be a one-piece component or, in additional embodiments, the module 72 may be a two-piece component having a first portion 74 and a second portion 76 mechanically connected to the first portion 74. The first portion 74 and second portion 76 may be mechanically coupled in a variety of ways. For example, the first and second portions 74, 76 may have corresponding threads such that the first portion 74 and second portion 76 form a threaded connection. The first portion 74 and second portion 76 may also be press fit together, adhered together, and/or otherwise coupled together in any known way.

The first portion 74 and second portion 76 may comprise one or more electrically conductive materials. The first portion 74 may comprise a first electrically conductive material and the second portion 76 may comprise a second electrically conductive material that is the same or different than the first electrically conductive material. In some embodiments, the first electrically conductive material may be more conductive than the second electrically conductive material. In further embodiments, the first electrically conductive material may be equally as conductive as the second electrically conductive material. The electrically conductive materials may comprise any metal or alloy known in the art and, in exemplary embodiments, the electrically conductive materials may comprise a bronze alloy, an aluminum alloy, a nickel, or copper alloy.

The mechanical connection between the first portion 74 and second portion 76 may provide intimate contact between the electrically conductive materials of the first and second portions 74, 76 such that the first portion 74 and second portion 76 may also be electrically connected. Alternatively, the first and second portion 74, 76 may be mechanically connected, but the two electrically conductive materials may be separated from one another such that the two materials do not contact each other. In such embodiments, an electrical connection may be formed between the first and second portions 74, 76 by alternative methods. One method may be via at least one lead (not shown). For example, the first portion 74 may be electrically connected and/or mechanically coupled to a first end of a lead, and the second portion 76 may be electrically connected and/or mechanically coupled to a second end of the lead opposite the first end. The electrical and/or mechanical connection may be via a solder joint formed between the lead and respective portions 74, 76. The first portion 74 and second portion 76 may also be electrically connected and/or mechanically coupled via a conductive adhesive and/or any other known way.

The second portion 76 may include a first opening 86 that aligns with a first opening 84 of the first portion 74. The first portion 74 may have a second opening 88 opposite the first opening 84 along the same axis 82. The second portion 76 may also have a second opening 90 opposite the first opening 86. The first openings 84, 86 may facilitate the mechanical and/or electrical connections described above between the first and second portions 74, 76 and the second opening 88 may allow one or more beams of radiation emitted by the light source 70 to exit the module 72 along a beam path 38. As shown in FIG. 3, the first portion 74 and second portion 76 may be aligned along the longitudinal axis 82 of the recoil spring guide, and the longitudinal axis 82 may be, for example, collinear with the beam path 38 of the light source 70.

The light source 70 may be disposed substantially within the module 72 and may comprise, for example, any of a variety of lasers or other known sources of visible or thermal radiation. The light source 70 may comprise, for example, any one of a green laser, a red laser, an infrared laser, an infrared light emitting diode ("LED"), a white and colored LED, a laser having an output of approximately 5 mW (it is understood that lasers having an output greater than approximately 5 mW or less than approximately 5 mW may also be used), an interband cascade laser ("ICL"), and a short wavelength infrared laser ("SWIR"). It is understood that a SWIR may emit a signal, beam, pulse, and/or other radiation having a wavelength of between, approximately 0.9 μm and approximately 2.5 μm.

In exemplary embodiments, the light source 70 described above may be at least partially disposed within and electrically connected to the second portion 76. In exemplary embodiments, the light source 70 may be connected to a contact 92 that may comprise a metal, metal alloy, and/or any other known conductive material. In such embodiments, the contact 92 may be soldered, press fit, and/or otherwise electrically connected and/or mechanically coupled to an inner surface 94 of the second portion 76. In some embodiments, the contact 92 may be electrically connected to an inner surface 98 of the first portion 74. For example, a lead may be electrically connected and/or mechanically coupled to the contact 92 on one end and on an opposite end, the lead may be electrically connected and/or mechanically coupled to the inner surface 98 of first portion 74. In further embodiments, at least one lead (not shown) may provide an electrical and/or mechanical connection between the light source 70 and second portion 76. The first end of the lead may be soldered to the light source 70 and a second end, opposite the first end, may be soldered to the inner surface 94 of the second portion 76. In still further embodiments, the light source 70 and second portion 76 may be otherwise electrically connected and/or mechanically coupled together in any known way.

As shown in FIG. 3, at least one optical component 100 may be coupled to the first portion 74. The optical component 100 may have an outer surface 96 mechanically connected to the inner surface 98 of the first portion 74. For example, the optical component 100 outer surface 96 may be press fit or adhered into the inner surface 98 of the first portion 74. In further embodiments, the optical component 100 may be fixed to the first portion 74 via a retaining ring, and/or a series of clamps, screws, brackets, fittings, or other like components. In still further embodiments, the optical component 100 and first portion 74 may be otherwise mechanically coupled in any known way.

In exemplary embodiments, the optical component 100 may be positioned a first fixed distance D along the longitudinal axis 82 from the light source 70. The optical component 100 may be configured to collimate radiation emitted by the light source 70 and/or otherwise condition a beam emitted from the light source 70 extending along the beam path 38. It is understood that optical component 100 may include any of a variety of lenses, zoom components, magnification components, windows, domes, diffraction gratings, filters, prisms, mirrors, and/or other like optical components, mechanical components, or combinations thereof. The optical component 100 may be disposed optically downstream of the light source 70 along and/or within the beam path 38. Due to its position along and/or within the beam path 38, and optically downstream of the light source 70, one or more beams of radiation emitted by the light source 70 may pass through, be shaped by, be conditioned by, and/or otherwise optically interact with the optical component 100 before exiting the module 72. In an exemplary embodiment, one or more optical components 100 of the type described herein may be positioned in the beam path 38 optically downstream of the light source 70.

In further embodiments, the first portion 74 and second portion 76 of the module may be a one-piece module. For example, light source 70 and optical component 100 may be disposed substantially within a single module. In some embodiments, light source 70 and optical component 100 may be able to move in relation to each other. The relative movement may facilitate the optical component 100 conditioning the one or more beams of radiation emitted by the light source 70.

As shown in FIG. 3, the module 72 may be disposed at least partially within the recoil spring guide 30. In exemplary embodiments, at least part of the module 72 may be positioned within the tube 54 such that an outer surface 110 of the module 72 forms a connection with an inner surface 112 of the tube 54. The connection may determine an axial location of the module 72 within the recoil spring guide 50 while still enabling the module to move in a direction transverse to the longitudinal axis 82. The motion may allow the center axis of the module 72 to be offset or rotated from longitudinal axis 82 by varying degrees. The connection may be a ball-in-socket connection or any other like flexible or adjustable mechanical connection known in the art. In some embodiments, the second opening 88 of the first portion 74 of the module 72 may be proximate the first opening 56 of the head 52. Further, the second opening 90 of the second portion 76 may be aligned opposite the first end 55 of the head 52. Radiation emitted by the light source 70 may exit the second opening 88 of the first portion 74 and continue to exit the recoil spring guide 30 along beam path 38 that may exit the first opening 56 of the head 52. As discussed previously, in some embodiments, the radiation may pass through the optical component 100 disposed along the beam path 38 prior to exiting the recoil spring guide 30.

As shown in FIG. 3, in some embodiments, a spacer 114 may be positioned proximate the module 72. For example, the spacer 114 may be positioned such that the spacer 114 substantially surrounds a cylindrical portion 150 of the outer surface 110 of the module 72. The spacer 114 may be substantially annular and may be compressible. The spacer 114 may contact an inner surface 152 of the head 52 when the module 72 is disposed within the recoil spring guide 30. The spacer 114 may provide proper resistance for aligning the module 72 and may prevent direct contact between the module 72 and the inner surface 152 of the head 52 of the recoil spring guide 30. In particular, the spacer 114 may facilitate relative movement between the module 72 and the recoil spring guide 30 required for aiming, aligning, and/or otherwise calibrating the light source 70. In exemplary embodiments, the spacer 114 may be an o-ring or other like components configured to provide resistance between the module 72 and the recoil spring guide 30.

In some embodiments, at least one fastener 116 (FIG. 4) may be configured to fixedly and/or desirably position the module 72 within and/or relative to the head 52 of the recoil spring guide 30. The fastener 116 may be a screw and may be made from a conductive material, for example, a metal, metal alloy and/or any other known conductive material. In further embodiments, the module 72 may be otherwise fixed within the recoil spring guide 30 using clamps, dowels, cementing agents, crimping, welding, magnets, or any other known methods.

Figure 4:
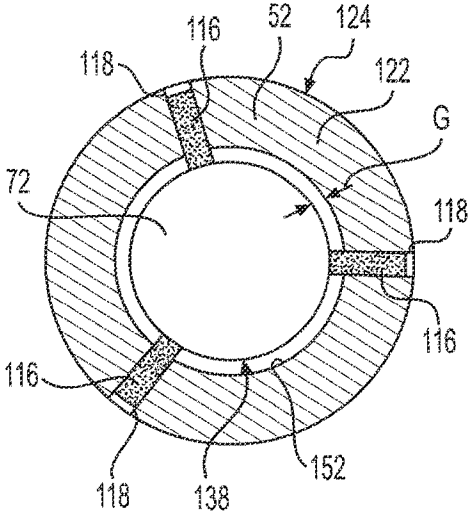
FIG. 4 is another cross-sectional view of the exemplary recoil spring guide shown in FIG. 2.

As shown in FIG. 4, in one embodiment, the module 72 may be fixed, and/or otherwise desirably positioned within and/or relative to the head 52 of the recoil spring guide 30 using two or more fasteners 116. The fasteners 116 may extend substantially perpendicular to the longitudinal axis 82 of the recoil spring guide 30. The fasteners 116 may be inserted into the head 52 of the recoil spring guide 30 via respective tapped holes 118. The tapped holes 118 may completely penetrate a wall 122 of the head 52 such that the fasteners 116 may be inserted from outside of the head 52. The fasteners 116 may also be long enough to contact the module 72 through the wall 122. In some embodiments, the tapped holes 118 may have a counterbore sized and/or otherwise configured to accept a head of respective fastener 116. Alternatively, as shown in FIG. 4, fasteners 116 may comprise substantially cylindrical set screws without heads. In such embodiments, the counterbore described above may be omitted.

Each fastener 116 may threaded into a respective tapped hole 118 and the depth at which each fastener 116 may be threaded into the head 52 of the recoil spring guide 30 may define a distance G between the cylindrical portion 150 of the module 72 and the inner surface 152 of the head 52. The defined distance G across the series of fasteners 116 may determine the orientation and/or alignment of the module 72 within the head 52 of the recoil spring guide 30. Distance G may not be a constant distance between the cylindrical surface 150 of the module 72 and the inner surface 152 of the head 52. For example, the module 72 may be positioned closer to a first portion of the inner surface 152 than a second portion of the inner surface 152 to achieve a desired angular orientation, alignment and/or calibration of the light source 70. In such embodiments, the beam path 38 of the light source 70 disposed within the module 72 may not be collinear with the longitudinal axis 82 of the recoil spring guide 30. In further embodiments, the fasteners 116 may be configured to contact a cylindrical portion 154 (FIG. 3) of the second portion 76 of the module 72.

As shown in FIG. 2, in exemplary embodiments, a circuit board 130 may be electrically connected and mechanically coupled to the light source 70. The circuit board 130 may be configured to control operation of the light source 70. The circuit board 130 may comprise a breadboard circuit board, a stripboard circuit board, a printed circuit board or any other known circuit boards. The circuit board 130 may include semiconductors, transistors, resistors, microprocessors, capacitors, inductive devices, transducers, converters, drivers, one or more pulse generators, encoders, amplifiers, pulse switchers, and/or any other known components that may aid in the functioning of the target marker 50. The electrical and mechanical connections between the circuit board 130 and the components of the circuit board 130 may depend upon the type of component being used and the type of circuit board 130 being used. Types of connections may include surface mounts, through-holes, two-piece connectors, backplane connections, or any other type of connections known. The circuit board 130 may include any appropriate components configured to assist in controllably operating the light source 70. The circuit board 130 and its components may be configured to modify the gain, contrast, brightness, color, output power, and/or other optical characteristics of the radiation emitted by the light source 70. Additionally, the circuit board 130 and its components may be configured to operate the light source 70 in either pulsed or continuous modes of operation. Such modes of operation of the light source 70 may be accomplished by any known means such as, but not limited to, modulating the current and/or voltage supplied to the light source 70.

The circuit board 130 may be electrically connected and mechanically coupled to the light source 70. In exemplary embodiments, at least one lead 132 may electrically connect the light source 70 and the circuit board 130. The at least one lead 132 may include a power lead, a ground lead, and/or a photodiode feedback lead. In such embodiments, the power lead may allow for the flow of electricity between the circuit board 130 and the light source 70, and the ground lead may provide a grounding mechanism for the various components of the circuit boards 130. The photodiode feedback lead may provide feedback to a microprocessor and/or other components on the circuit board 130 which may control the amount of current and/or voltage directed to the light source 70.

The lead 132 may be fixed to the circuit board 130 such that it maintains a fixed axial distance F between the light source 70 disposed within the module 72 and the circuit board 130. In particular, the lead 132 may assist in maintaining a fixed axial distance between contact 92 and the circuit board 130. In exemplary embodiments, the lead 132 may permit relative angular movement between the circuit board 130 and the light source 70 while maintaining the fixed axial distance F between the circuit board 130 and the light source 70. For example, the lead 132 may permit a varying spatial orientation between the circuit board 130 and light source 70. For example, the lead 132 may permit the light source 70 to move in a direction transverse relative to longitudinal axis 82 as shown by arrow J in FIG. 3. The motion may result in the circuit board being angularly offset from the longitudinal axis 82. As mentioned previously, this may cause the beam path 38 of the light source 70 not to be collinear with the longitudinal axis 82 of the recoil spring guide 30. The lead 132 may be fashioned from a material such that the lead 132 does not break under external forces witnessed during the alignment and/or calibration of the module 72 (discussed below). The lead 132 may be connected to the contact 92 and the circuit board 130 by a solder joint or any other method known. The lead 132 may be configured to allow the flow of electricity between the circuit board 130 and the light source 70.

In exemplary embodiments, one or more additional leads may be affixed in such a way that they do not provide additional restriction of motion between the light source 70 and the circuit board 130 when each is disposed within the recoil spring guide 30. The one or more additional leads may be made from a flexible material such as flexible electrical wires or other flexible connectors known in the art. They may be connected to the light source 70 and circuit board 130 via a solder connection, or other known methods.

The target marker 50 may also include a power source 138. The power source 138 may be any source of power known in the art such as, for example, one or more batteries. In an exemplary embodiment, the power source 138 may comprise a plurality of zinc-air batteries, lithium cell batteries, alkaline batteries, button cell batteries, and/or coin cell coin batteries. The power source 138 may be, for example, disposable and/or rechargeable, and the power source 138 may be configured to supply power to any of the light sources 70 described above.

The power source 138 may be operably connected to the circuit board 130, the light source 70, and/or any of the other target marker components described herein. Furthermore, the power source 138 may be selectively electrically connected to the circuit board 130 which may be configured to energize the light source 70. Although FIG. 2 illustrates the power source 138 being disposed within the tube 54, in additional exemplary embodiments, the power source 138 may be disposed outside of the tube 54 and/or the recoil spring guide 30. In an exemplary embodiment, the power source 138 may be disposed on and/or otherwise mounted to the firearm 10 to which the target marker 50 is connected.

In exemplary embodiments, the power source 138 may be located proximate the circuit board 130 within the recoil spring guide 30. A spring 140 may be disposed between the circuit board 130 and the power source 138. The spring 140 may exert a positive bias force on the circuit board 130 and power source 138 to maintain a constant mechanical and electrical connection between these two components. In some embodiments, the spring 140 may be soldered and/or otherwise electrically connected to the circuit board 130. The spring 140 may have a spring rate such that the bias force exerted on the power source 138 may not be greater than a retention force, (discussed below) coupling the cover 142 and the tube 54. Fixed distance M may locate an end 80 of the circuit board 130 and may comprise distance F, and a length L of the circuit board 130. In other exemplary embodiments, the fixed distance M may comprise distance F, length L, and an additional distance N. Distance N may be the length of a tail 148 of the circuit board 130. For example, the circuit board 130 may be electrically connected to the power source 138 via a spring 140 disposed between the power source 138 and the tail 148 of the circuit board 130.

As shown in FIG. 2, in exemplary embodiments, the cover 142 may be coupled to the second end 62 of the tube 54. In some embodiments, the cover 142 may be removable from the recoil spring guide 30. The cover 142 may allow for the power source 138 to be removed and replaced with a new or refreshed power source 138. The cover 142 may be attached to the tube 54 via a plethora of methods. For example, the tube 54 and the cover 142 may contain corresponding threads (not shown) such that the cover 142 and tube 54 may form a threaded connection. In further exemplary embodiments, the tube 54 and cover 142 may be press fit together. The press fit may be configured such that a frictional retention force between an outer surface 145 of the cover 142 and an inner surface 143 of the tube 54 may be overcome using hand force, but as mentioned previously, the retention force may be strong enough to prevent the bias force of the spring 140 from disengaging the cover 142 from the tube 54. In further embodiments, the cover 142 or the tube 54 may include a spacer 144 providing a substantially fluid tight seal and retention force between the cover 142 and the tube 54. The spacer 144 may be annular and compressible and in exemplary embodiments, the spacer 144 may comprise an o-ring and/or other component similar to spacer 114. The cover 142 may comprise a non-conductive material and may include a contact 146 made from a conductive material such as a metal or alloy. In further embodiments, the cover 142 may comprise a conductive material, for example, a metal or alloy.

In some embodiments, the cover 142 may only be installed onto the tube 54 of the recoil spring guide 30 in a single orientation. The orientation may set a circumferential alignment between the tube 54 and the cover 142. For example, the second end 62 of the tube 54 may include a first feature (not shown) configured to accept second feature (not shown) on the cover 142. The first and second features may include at least one of a notch, groove, cutout, or any other feature such that the first and second feature mate together.

Additionally, in further embodiments, the recoil spring guide 30 may only be installed on the firearm 10 in a single orientation. The orientation may set a circumferential alignment between the firearm 10 and the cover 142. For example, the cover 142 may contain a third feature (not shown) that may mate with a fourth feature (not shown) on the firearm 10. The third and fourth features may include at least one of a notch, groove, cutout, or any other feature such that the third and fourth feature mate together. In still further embodiments, the first and second feature may align with the third and fourth feature such that the series of features may be spatially aligned in a circumferential orientation such that the recoil spring guide 30 is consistently installed into the firearm 10 to maintain an alignment between the module 72 of the target marker 50 and the firearm 10.

In exemplary embodiments, the target marker 50 may be aligned. The alignment may occur after the one or more components of the target marker 50 have been assembled. Aligning the target marker 50 may ensure the beam path 38 of the light source 70 highlights a desired point of impact on a target. The alignment may be achieved by adjusting the location of the module 72 within the head 52 of the recoil spring guide 30. As discussed previously, the location of the module 72 within the head 52 may be set using one or more fasteners 116 (FIG. 4). For example, the fasteners 116 may determine the location of the light source 70, disposed within the module 72, relative to the head 52 of the recoil spring guide 30. For example, the position of module 72 within the recoil spring guide 30 may be adjusted to align the beam path 38 with the longitudinal axis 82 of the recoil spring guide 30. In some embodiments, the beam path 38 and the longitudinal axis 82 of the recoil spring guide 30 may not be collinear. The position of module 72 within the recoil spring guide 30 may depend on the firearm 10 the recoil spring guide 30 is designed for.

Relative movement of the module 72 during such alignment and/or calibration may cause the module 72 to move relative to, for example, the circuit board 130 and/or the recoil spring guide 30. As mentioned previously, the lead 132 may maintain fixed axial distance F but may allow the module 72 to move in a direction transverse relative to the longitudinal axis 82 as shown by arrow J in FIG. 3. The relative movement may be arcuate or angular movement. The relative movement may allow a center axis of the module 72 to be offset at an angle to the longitudinal axis 82. Such relative movement may be facilitated without damaging components and/or breaking electrical/mechanical connections by, for example, the flexible connection between light source 70 and circuit board 130. The relative movement may be minute or may vary by a few degrees.

Once the module 72 is accurately aligned, the fasteners 116 may be fixed into place with a medium. The medium may be a form of glue such that the fasteners 116 cannot be loosened or removed during operation. In other embodiments, the fastener 116 may be a self-locking fastener. In still further embodiments, the fastener 116 may be fixed with a wire, preventing the fastener 116 from backing out of the tapped hole 76. The fastener 116 may otherwise be fixed into place with any other known methods.

After the target marker 50 has been aligned to highlight the desired impact point of a bullet, the recoil spring guide 30 may be filled with a medium (not shown) to secure the location of one or more components of the target marker 50. The medium may be an expandable insulating medium, and the medium may completely encapsulate the one or more components inside of the recoil spring guide 30. In some embodiments, the medium may also provide dampening capabilities to protect the components from vibration. For example, the medium, once disposed within the recoil spring guide 30 may harden, firmly immobilizing the one or more components of the target marker 50.

Figure 5:
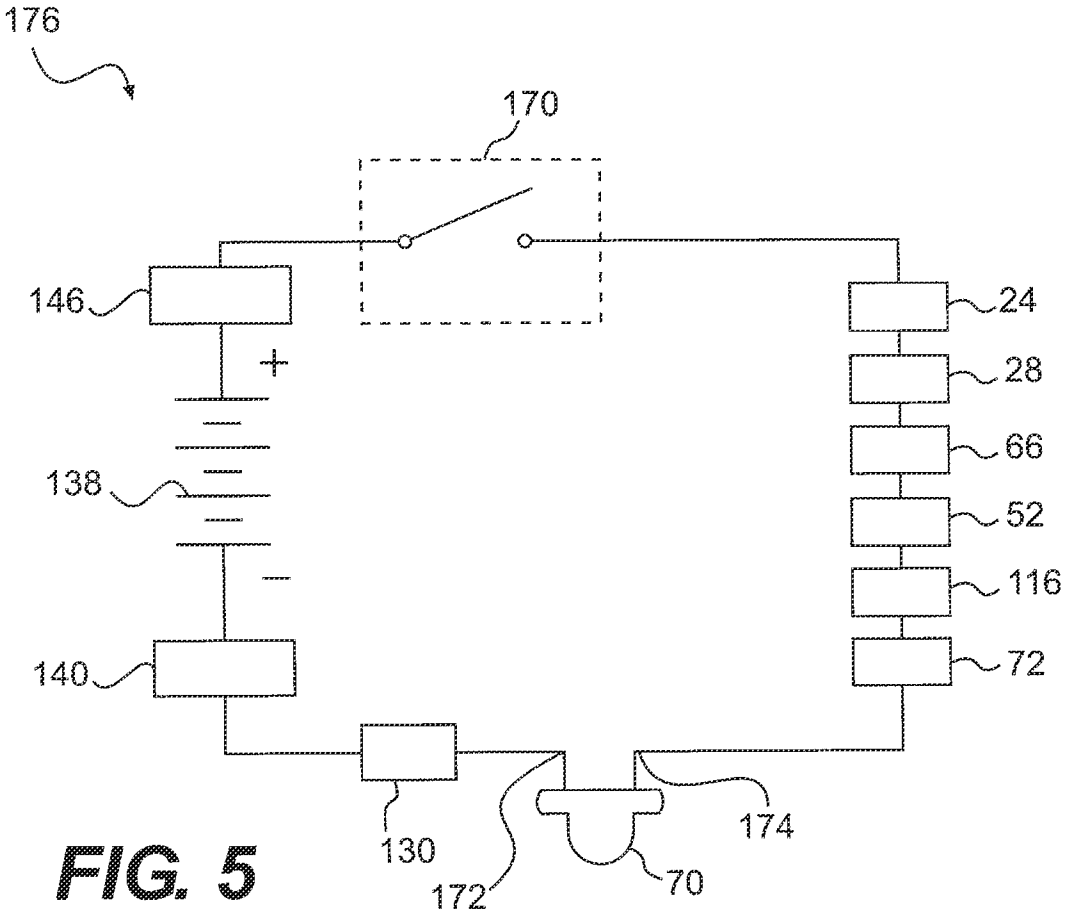
FIG. 5 is an exemplary electrical schematic associated with an exemplary target marker of the present disclosure.

FIG. 5 displays an exemplary electrical circuit 176 associated with the target marker 50. In exemplary embodiments, one contact 172 of the light source 70 may be electrically connected and mechanically coupled to the circuit board 130. This connection may be established via the at least one lead 132 as discussed previously. The connection may include a ground lead for the electrical circuit 176. The connection may also include a power lead to allow the flow of electricity between the circuit board 130 and light source 70. The circuit board 130 may be connected to a power source 138 via the spring 140. In exemplary embodiments, the spring 140 may be disposed between the power source 138 and the tail 148 of the circuit board 130 to provide such a connection. The power source 138 may be connected to a switch 170. The switch 170 and the power source 138 may be electrically connected through the cover 142 if the cover 142 comprises a conductive material. In an exemplary embodiment, as shown in FIG. 5, the power source 138 and switch 170 may be electrically connected through the conductive contact 146 disposed within the cover 142.

The switch 170 may have at least one insulated portion and at least one electrically conductive portion. The switch 170 may be moveable between a first position and a second position. The first position may comprise an "on" position that may be characterized by a closed circuit. The second position may comprise an "off" position that may be characterized by an open circuit. The off-position may be configured such that the insulated or non-conductive portion may be aligned with the conductive contact 146. Such non-conductive portion may comprise, for example, an air gap. Conversely, the on-position may be configured such that the conductive portion may be aligned with the conductive contact 146. In some embodiments, the switch 170 may also contain a third position, which may be electrically conductive. The third position may comprise an "on" position that may be characterized by a closed circuit. In a further embodiment, the slide lock 34 may be configured to act as the switch 170.

A second contact 174 of the light source 70 may be selectively connected to the power source 138 through the module 72. As discussed previously, the light source 70 may be electrically connected to an inner surface 94 of the second portion 76 of the module 72 via the contact 92. The inner surface 94 of the second portion 76 is electrically connected to the first portion 74 of the module 72 as discussed previously.

The cylindrical surface 150 of the module 72 may be electrically connected to the fastener 116 by the contact between the cylindrical surface 150 of the module 72 and the fastener 116. The fastener 116 may electrically connect and mechanically contact the head 52 of the recoil spring guide 30 through the tapped hole 118. The head 52 then may be electrically connected to the captivator 66 through the electrical and/or mechanical connections described above. The captivator 66 may be electrically connected to the slide 24 of the firearm 10. In further embodiments, such as those in which the captivator has been omitted, the head 52 may be electrically connected to the slide 24. The switch 170 may be electrically connected and mechanically coupled to the slide 24 of the firearm 10, which may complete the circuit.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. An electronic device for use with a hand-held projectile launcher, the electronic device comprising:

a first portion in front of a light source;

a second portion joinable to the first portion to substantially enclose the light source between the first portion and the second portion; and a circuit board electrically connected to the light source at a first end of the circuit board via a connection that holds an exterior surface of the light source at a predetermined longitudinal distance from a second end of the circuit board, wherein the circuit board and the light source are configured to permit relative angular movement between the circuit board and the light source, and wherein the connection is configured to permit the relative angular movement between the circuit board and the light source such that the connection maintains the predetermined longitudinal distance between the exterior surface of the circuit board and the light source.

2. The electronic device of claim 1, further comprising an electrically conductive resilient member positioned between the second end of the circuit board and an end of the first portion.

3. The electronic device of claim 2, further comprising a cap joinable to the second portion to contain a power supply between the second end of the circuit board and the cap.

4. The electronic device of claim 3 wherein the cap incorporates an electrically conductive portion.

5. The electronic device of claim 4, wherein the electrically conductive portion of the cap provides an electrical path from the power supply to a tubular module portion and wherein the tubular module portion is electrically conductive to provide at least a part of an electrical path from the power supply to the light source.

6. The electronic device of claim 3, wherein the electrically conductive resilient member is deformed longitudinally when contained with the power supply between the second end of the circuit board and the cap and is configured to apply a resilient bias against the power supply to cause the power supply to remain in a position where an electrically conductive portion of the cap is configured to electrically connect to the power supply during firing of the hand-held projectile launcher.

7. The electronic device of claim 6, wherein the electrically conductive resilient member is joined to the second end of the circuit board.

8. The electronic device of claim 7, wherein the electrically conductive portion of the cap is movable between (i) a closed position such that the electrically conductive portion contacts the power supply as positioned by the electrically conductive resilient member and (ii) an open position separated from the electrically conductive resilient member.

9. The electronic device of claim 8, wherein the electrically conductive portion of the cap provides an electrical path from the power supply to the first portion when the electrically conductive portion is in the closed position and wherein the first portion is electrically conductive to provide at least a part of an electrical path from the power supply to the light source.

10. The electronic device of claim 1, wherein the connection and the exterior surface of the light source are configured to interact to allow angular adjustment of the light source relative to the circuit board while maintaining the predetermined longitudinal distance between the second end of the circuit board and the exterior surface of the light source.

* * * * *